US006126488A

United States Patent [19]

Daoud

[11] Patent Number: 6,126,488

[45] Date of Patent: Oct. 3, 2000

[54] NETWORK INTERFACE DEVICE RETROFIT MODULE FOR SELECTIVE PAIRS ON A 66-TYPE BLOCK

[75] Inventor: Bassel Hage Daoud, Parsippany, N.J.

[73] Assignee: Lucent Technologies, Inc., Murray Hill, N.J.

[21] Appl. No.: 09/107,488

[22] Filed: Jun. 30, 1998

[51] Int. Cl.[7] ..... H01R 24/00

[52] U.S. Cl. ..... 439/676

[58] Field of Search ..... 439/676, 638

[56] References Cited

U.S. PATENT DOCUMENTS 5,260,994 11/1993 Suffi ..... 439/676

5,328,390 7/1994 Johnston et al. ..... 439/676

*Primary Examiner*—Lincoln Donovan

*Assistant Examiner*—Antoine Ngandjui

*Attorney, Agent, or Firm*—Birch, Stewart, Kolasch & Birch, LLP

[57] ABSTRACT

A network interface device is connectable to the terminals of an intermediate field of a building entrance protector unit. The network interface device includes a jack which is design to receive the plug of a standard telephone. The jack has a connector portion having a plurality of spring clips which are insertable onto the terminals of the intermediate field. A plug section is pivotally connected to the jack by a living hinge. The plug section includes a plug having a pair of conductive blades therein. The network interface device performs a connecting function when the plug is pivoted to a position within the jack, and the conductive blades establish an electrical connection between the telephone company network and the customer equipment. When there is a need to disconnect the customer from the telephone company network or to test the system, the plug can simply be pivoted out of the jack, and a standard working telephone can be plugged into the jack for line testing purposes.

20 Claims, 7 Drawing Sheets

NETWORK INTERFACE DEVICE RETROFIT MODULE FOR SELECTIVE PAIRS ON A 66-TYPE BLOCK

BACKGROUND OF THE INVENTION

1. Field of the Invention

The present invention relates to a connector for providing an electrical connecting between a telephone network and a customer, and more particularly, to a network interface device attachable to an intermediate field of a building entrance protector which additionally provides a convenient disconnect function so that the customer can be disconnected from the telephone network, and a standard telephone may be plugged into the network interface device for line testing purposes.

2. Description of the Background Art

Network interface units constitute the separation between the telephone company network and a customer's equipment. In buildings having multiple subscribers, the network interface unit may comprise a building entrance protector, which is typically installed in the basement of the building.

One example of such a building entrance protector is shown in FIGS. 9 and 10. The building entrance protector 100 includes a box 102 having a lid 104 pivotally attached thereto to form an enclosure. A cable 106 from the telephone company central office is fed to the interior of the box 102. The cable 106 includes multiple pairs of wires which are connected to protector modules arranged on a protector field 108. The connection is typically made using a wire wrap 110 on the underside of the protector field 108. The protector modules provide protection against electrical surges for the customer.

From the protector modules, the wire pairs are connected to selected terminals 112*a* on the underside of an intermediate field 112, commonly known as a 66-type block. A cable 114 from the customers is also fed to the interior of the box 102. The cable 114 may typically include twenty-five wire pairs entering into the box 102 through an RJ21 connector 116. Wire pairs from the customers are connected to selected other terminals 112*b* on the underside of the intermediate field 112.

In order to interconnect the network side terminals 112*a* to the customer side terminals 112*b*, it is known to use bridging clips 118 which are placed over adjacent terminals 112*a*, 112*b* on the upper side of the intermediate field 112, as shown in FIG. 10. A pair of bridging clips 118 are used to connect the pair of terminals 112*a* on the network side to the pair of terminals 112*b* of the customer, in order to establish an electrical connection. In order to disconnect the customer side equipment from the network side equipment, it is necessary to remove the bridging clips 118 from the terminals 112*a*, 112*b*.

At times, a problem with the telephone service of the customer will develop. It is useful for the customer to be able to plug a working telephone into a test jack in order to determine whether the problem exists in the lines of the telephone company or the lines of the customer. However, the method of interconnection using bridging clips does not provide a mechanism for allowing the customer to plug a working telephone into the network for testing purposes.

There is a need in the art for a network interface device which can quickly and easily connect the customer to the telephone network, while providing a disconnect feature whereby the customer can be disconnected from the telephone network, and a standard telephone may be plugged into the network interface device for line testing purposes.

SUMMARY OF THE NVENTION

The present invention fulfills the aforementioned need in the art by providing a network interface device which is connectable to the terminals of an intermediate field, and which provides both a connecting and a disconnecting function. The network interface device includes a jack which is designed to receive the plug of a standard telephone. The jack has a connector portion having a plurality of spring clips which are insertable onto the terminals of the intermediate field. A plug section is pivotally connected to the jack by a living hinge. The plug section includes a plug having a pair of conductive blades therein. When the plug is pivoted to a position within the jack, the conductive blades establish an electrical connection between the spring clips attached to the network side terminals and the spring clips attached to the customer side terminals. Thus, an electrical connection is established between the telephone company network and the customer equipment. When there is a need to test the system, the plug can simply be pivoted out of the jack, and a working telephone can be plugged into the jack for testing purposes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
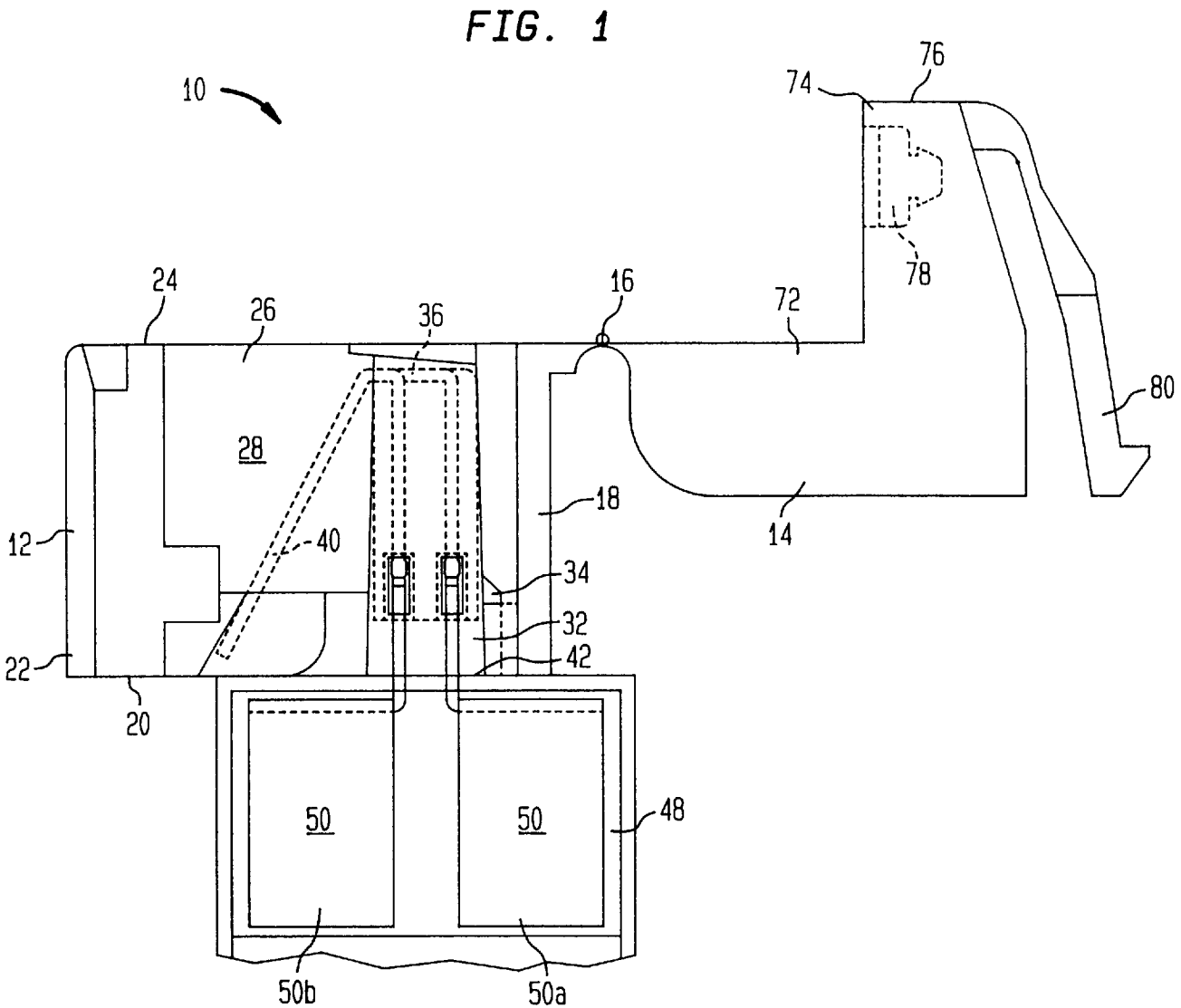
FIG. 1 is a side view of a network interface device according to the present invention.
Figure 3:
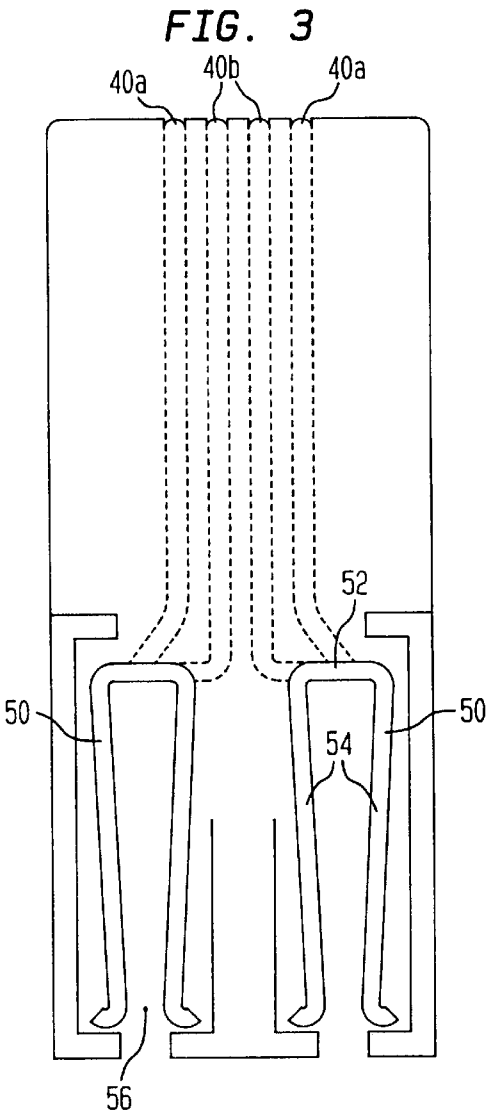
FIG. 3 is an end view of the insert.
Figure 2:
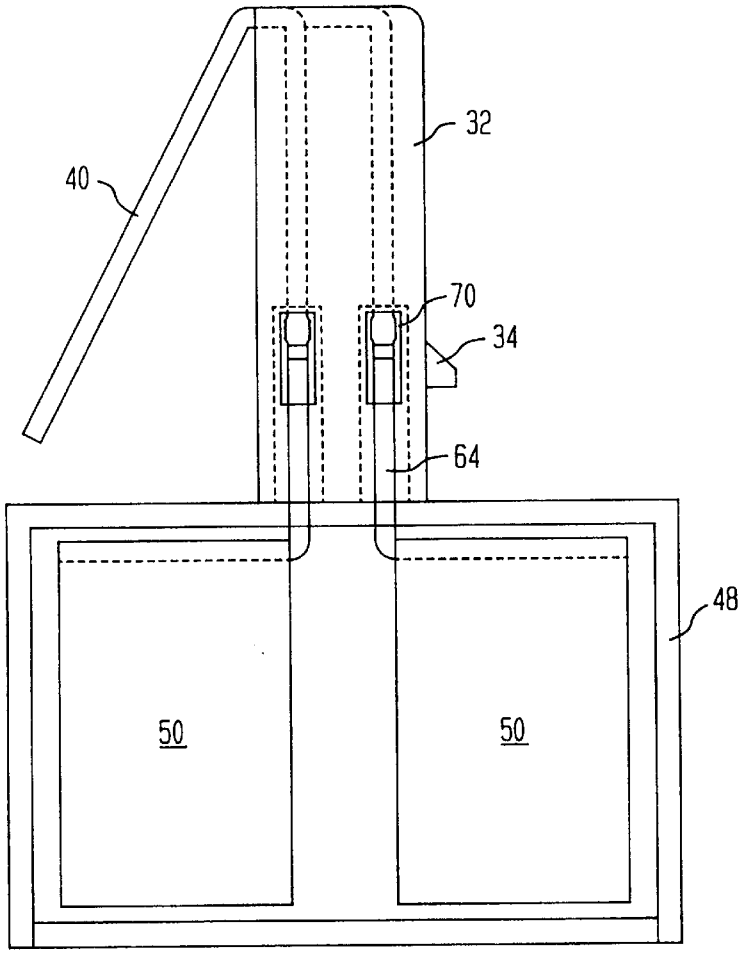
FIG. 2 is a side view of an insert of the network interface device.

Referring in detail to the drawings, and with particular reference to FIG. 1, a network interface device 10 of the present invention is shown. The network interface device 10 includes a jack section 12 and a plug section 14 pivotally connected to the jack section 12 by a living hinge 16. The jack section 12 and the plug section 14 are preferably formed as an integral one-piece unit from an insulative plastic material, such as polypropylene.

The jack section 12 has an essentially block-like main body 18. A lower portion 20 of the main body 18 is formed as a rectangular base 22. A upper surface 24 of the main body 18 includes an essentially rectangular aperture 26 therein which extends downwardly into the main body 18. The aperture 26 forms a jack 28 similar to a conventional telephone wall jack.

An insert 32 is located within the aperture 26 at one side thereof and is held in place by a hook 34 projecting from the insert 32. An upper portion 36 of the insert 32 contains four spring wires 40 extending therefrom. The spring wires 40 comprise an outermost pair 40*a* and an innermost pair 40*b*. The spring wires 40 form contact points for the plug section 14 which will be described in detail later.

Figure 5:
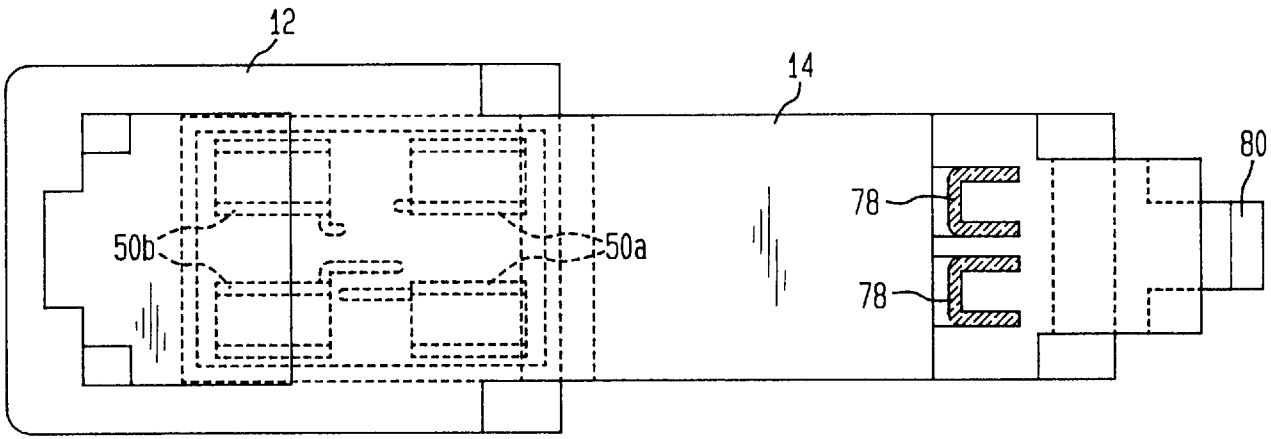
FIG. 5 is a top view of the network interface device in an open position showing the lower connector portion of the insert with spring clips therein.
Figure 7:
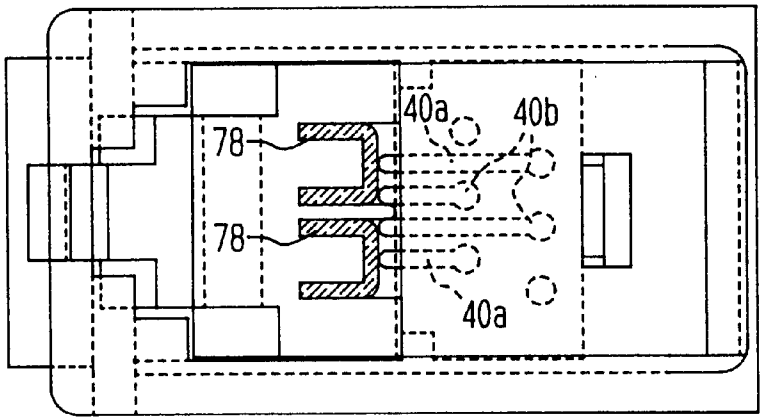
FIG. 7 is a top view of the network interface device in a closed position showing the blades contacting the spring wires.
Figure 6:
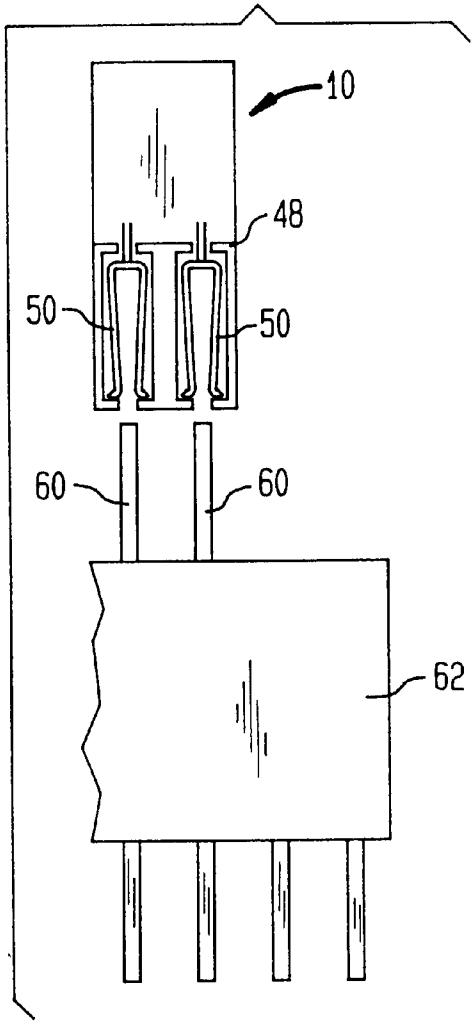
FIG. 6 is a schematic exploded view showing the insertion of the connector onto an intermediate field.
Figure 8:
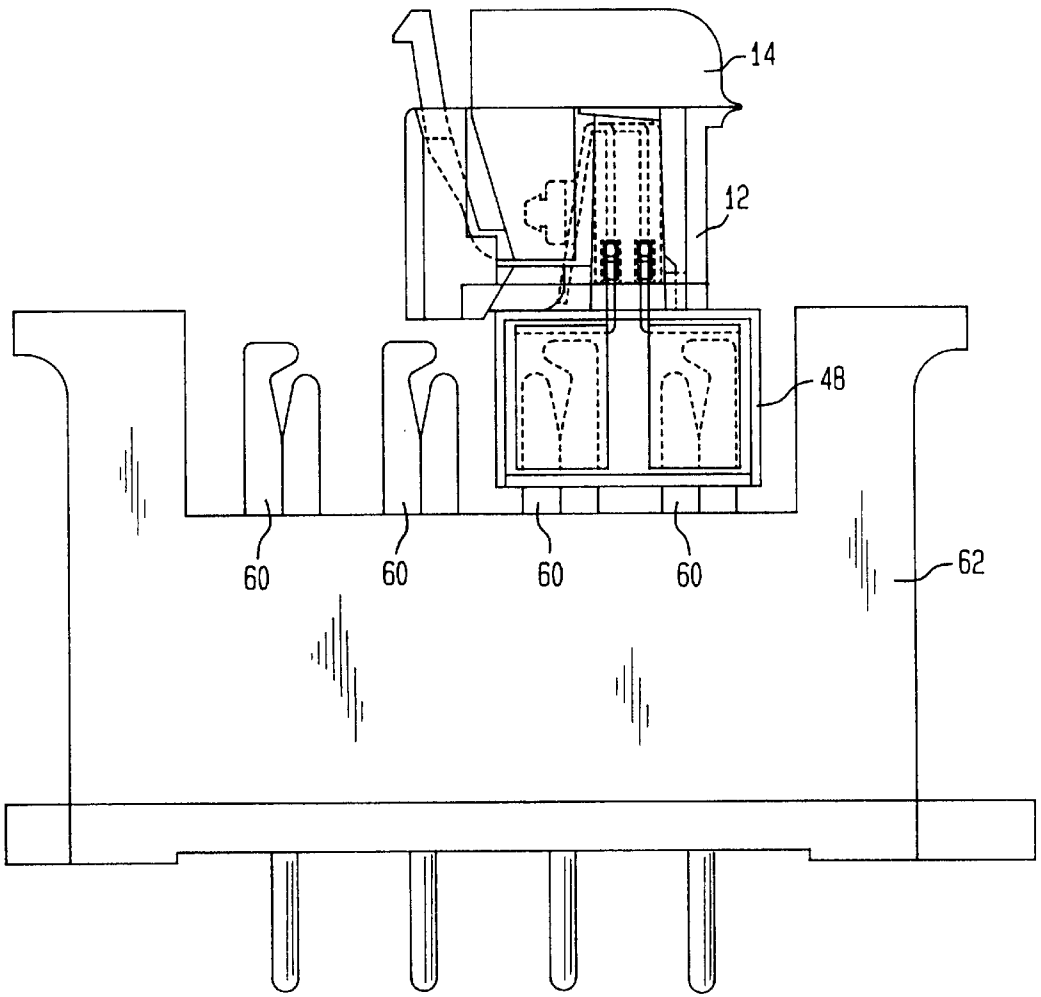
FIG. 8 is a side view showing the network interface device installed onto the terminals of an intermediate field.
Figure 9:
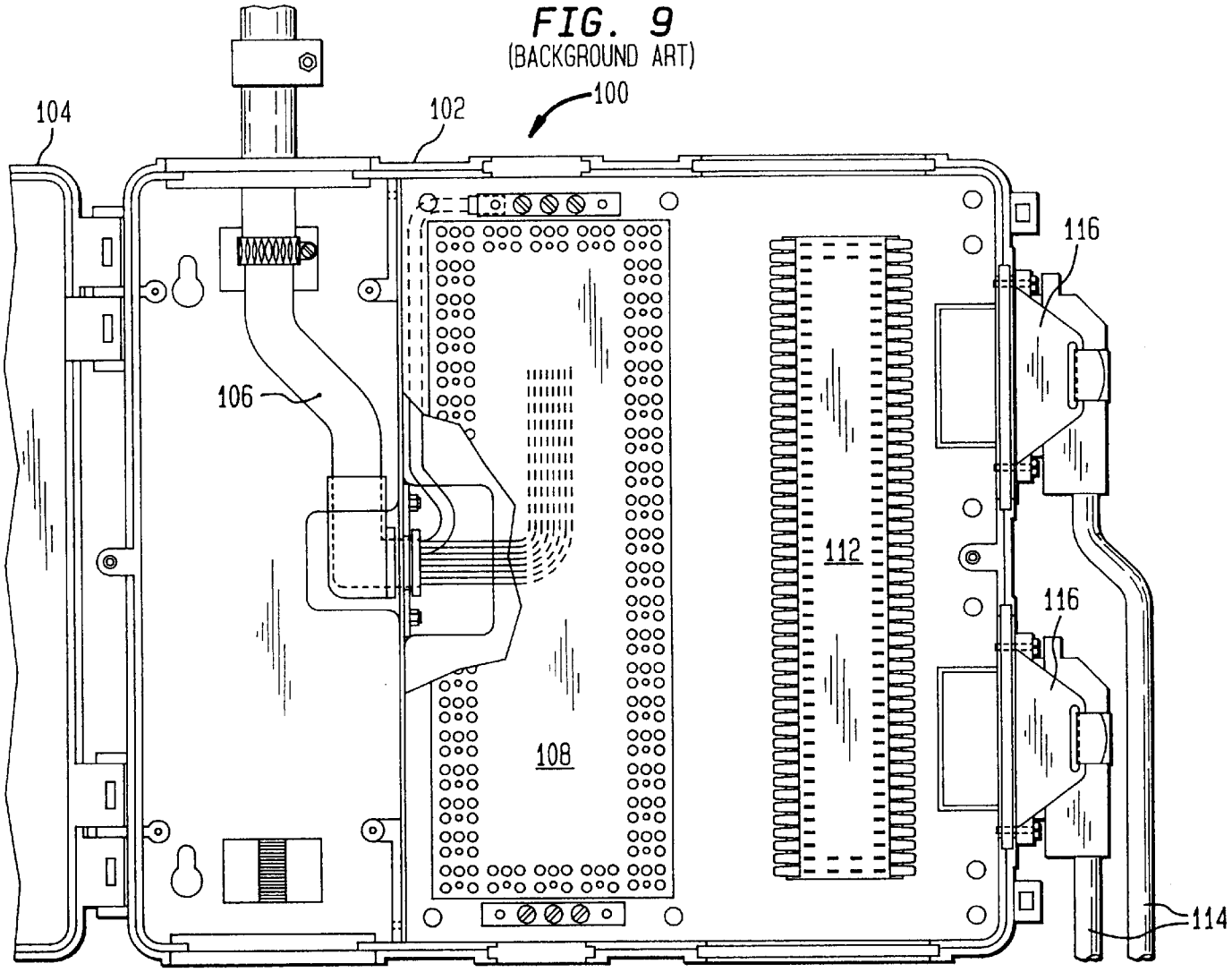
FIG. 9 (BACKGROUND ART)
FIG. 9 is a plan view of a building entrance protector of the background art.
Figure 10:
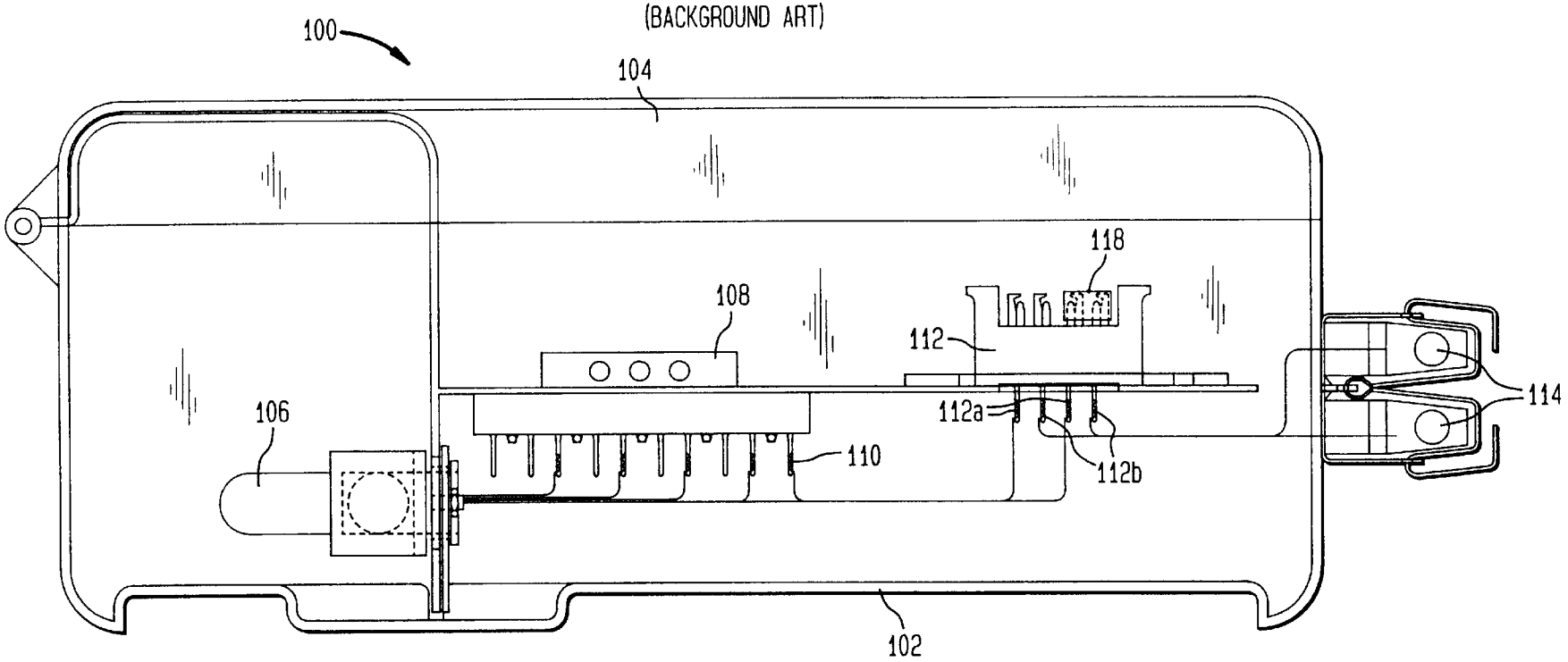
FIG. 10 (BACKGROUND ART)
FIG. 10 is an end view of the building entrance protector of the background art showing a bridging clip on the terminals of the intermediate field.

A lower portion 42 of the insert 32 comprises a connector 48. The connector 48 includes four spring clips 50 which are arranged in two pairs 50*a*, 50*b* in a two-by-two matrix. The spring clips 50 have an essentially inverted U-shape formed by a central portion 52 and a pair of depending legs 54, as shown in FIG. 5. The spring clips 50 may be formed of phosphorbronze or other conductive material. An opening 56 at the lower end of each spring clip 50 between the legs 54 is configured to receive a terminal 60 of an intermediate field 62, or 66-type block, therein. The opening 56 of the spring clips 50 can expand due to the resilience of the spring clips 50 to accommodate the terminal 60 therein, while providing a good electrical connection between the spring clip 50 and the respective terminal 60.

Each of the spring clips 50 is attached to a respective one of the spring wires 40. In order to attach the spring clips 50 to the spring wires 40, a portion of each spring clip 50 is bent to form a post 64. The post 64 extends from the top of the spring clips 50, as shown in FIG. 1. The posts 64 are attached to the spring wires 40 by suitable connectors 70, such as solderless crimped connectors. Of course, it is envisioned that other manners of connecting the spring clips 50 to the spring wires 40 may be utilized, such as wires connected to the spring clips 50 by soldering or crimping.

Figure 4:
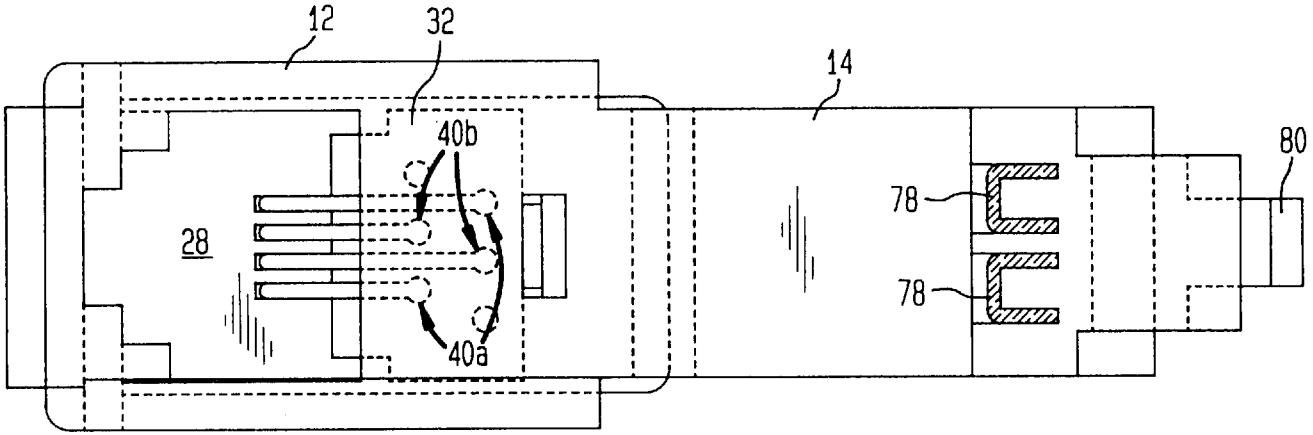
FIG. 4 is a top view of the network interface device in an open position showing the upper portion of the insert with spring wires therein.

As shown by studying FIGS. 4 and 5, the two spring clips 50*a* closest to the living hinge are electrically connected to the two outermost spring wires 40*a*, and the two spring clips 50*b* farthest from the living hinge are electrically connected to the two innermost spring wires 40*b*.

The connector 48 can be mounted onto the terminals 60 of the intermediate field 62. When the connector 48 is installed onto the intermediate field 62, the two spring clips 50*a*, along with the attached spring wires 40*a*, are electrically connected to the customer premises side. Also, the other two spring clips 50*b*, along with their respective spring wires 40*b*, are electrically connected to the central office or telephone network side.

The plug section 14 has a main body portion 72 having a plug 74 extending from a lower side 76 thereof. A pair of blades 78 are located within the plug 74. The blades 78 may be formed of phosphorbronze or other conductive material. The plug section 14 is pivotal about the living hinge 16 from an open position where the plug 74 is out of and spaced from the jack 28, to a closed position where the plug 74 is received within the jack 28. A latch 80 is provided on the plug section 14 for latching the plug section 14 to the jack section 12 in a closed position.

When the plug 74 is not located in the jack 28, no interconnections are made between the spring clips 50*a* and the spring clips 50*b*. Thus, the customer premises is disconnected from the central office of the telephone network side. At this time, a standard four pin RJ11 plug of a test telephone (not shown) may be plugged into the jack 28 for testing purposes. This arrangement allows simultaneous monitoring of the central office line and the customer line.

When the plug section 14 is pivoted to the closed position where the plug 74 is located within the jack 28, the blades 78 located in the plug 74 make contact with respective pairs of the spring wires 40 in the jack 28. The blades 78 therefore establish an electrical interconnection between the spring clips 50*a* and the spring clips 50*b*. In this orientation with the plug section 14 in the closed position, an electrical connection is established between the customer side and the telephone network side.

The network interface device 10 of the present invention may be utilized on all of the terminals 60 on the intermediate field 62. However, it is desirable not to utilize this network interface device 10 on terminals 60 which are attached to special telephone lines, such as payphones and alarms, in order to avoid a situation where the alarm circuit is inadvertently disconnected. Instead, it is desirable to cover the terminals 60 of these devices with special caps (not shown) to prevent them from being disconnected and to prevent a network interface device 10 from being inadvertently connected onto them.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connector comprising:

a jack section including a jack and a plurality of electrically conductive spring clips, a first spring clip of said plurality of spring clips being electrically isolated from a second spring clip of said plurality of spring clips; and a plug section including a plug insertable into said jack, said plug having at least one conductive blade therein, wherein said plug is insertable into said jack such that said at least one blade electrically connects the first spring clip to the second spring clip.

2. A connector comprising:

a jack section including a jack;

an insert located at least partially within said jack section, said insert including a plurality of electrically conductive spring clips, a first spring clip of said plurality of spring clips being electrically isolated from a second spring clip of said plurality of spring clips, said insert further including a plurality of spring wires extending therefrom and into said jack, said first spring clip being electrically connected to a first one of said plurality of spring wires, and said second spring clip being electrically connected to a second one of said plurality of spring wires; and a plug section including a plug insertable into said jack, said plug having at least one conductive blade therein, said plug being insertable into said jack such that said at least one conductive blade engages said first one of said spring wires and said second one of said spring wires, thereby electrically connecting said first one of said spring wires to said second one of said spring wires, to thereby establish an electrical connection path between said first spring clip and said second spring clip.

3. The connector according to claim 2, further comprising a hinge pivotally connecting said plug section to said jack section such that said plug section may be moved from a closed position where said plug is located within said jack, to an open position where said plug is located outside of said jack.

4. The connector according to claim 2, wherein said at least one conductive blade is engagable with at least two of said plurality of spring wires.

5. The connector according to claim 2, wherein each of said plurality of electrically conductive spring clips includes a post extending upwardly therefrom and connected to a respective one of said plurality of spring wires.

6. The connector according to claim 2, wherein said plurality of electrically conductive spring clips comprises four spring clips arranged in a two-by-two matrix.

7. The connector according to claim 2, wherein each of said spring clips comprises a central portion and a pair of legs depending therefrom.

8. The connector according to claim 2, wherein said jack is configured to receive a standard 4-pin RJ11 plug of a conventional telephone.

9. The connector according to claim 2, wherein said jack section and said plug section are an integral one-piece unit.

10. The connector according to claim 2, wherein said plurality of spring wires comprises a first pair of inner spring wires and a second pair of outer spring wires.

11. The connector according to claim 10, further comprising a pair of said conductive blades, a first of said pair of conductive blades being engagable with one of said first pair of inner spring wires and an adjacent one of said second pair of outer spring wires, and a second of said pair of conductive blades being engagable with the other of said first pair of inner spring wires and an adjacent one of said second pair of outer spring wires.

12. A network interface device connectable to first and second terminals extending outwardly from an intermediate field, said network interface device comprising:

a jack section including a jack;

an insert located at least partially within said jack section, said insert including a first electrically conductive spring clip and a second electrically conductive spring clip, said first spring clip and said second spring clip being electrically isolated from one another, said first spring clip being directly engagable with said first terminal on said intermediate field, and said second spring clip being directly engagable with said second terminal on said intermediate field, said insert further including a plurality of spring wires extending therefrom and into said jack, said first spring clip being electrically connected to a first one of said plurality of spring wires, and said second spring clip being electrically connected to a second one of said plurality of spring wires; and a plug section including a plug insertable into said jack, said plug having at least one conductive blade therein, said plug being insertable into said jack such that said at least one conductive blade engages said first one of said spring wires and said second one of said spring wires, thereby electrically connecting said first one of said spring wires to said second one of said spring wires, to thereby establish an electrical connection path between said first spring clip and said second spring clip, and thereby electrically connect the first terminal of the intermediate field to the second terminal of the intermediate field.

13. The network interface device according to claim 12, wherein said intermediate field is a Type-66 block.

14. The network interface device according to claim 12, wherein each of said spring clips comprises a central portion and a pair of legs depending from said central portion, said legs engagable with opposite sides of the terminals of the intermediate field.

15. The network interface device according to claim 12, wherein said plurality of spring wires comprises a first pair of inner spring wires and a second pair of outer spring wires.

16. The network interface device according to claim 15, further comprising a pair of said conductive blades, a first of said pair of conductive blades being engagable with one of said first pair of inner spring wires and an adjacent one of said second pair of outer spring wires, and a second of said pair of conductive blades being engagable with the other of said first pair of inner spring wires and an adjacent one of said second pair of outer spring wires.

17. The network interface device according to claim 16, wherein said intermediate field includes third and fourth terminals, and said network interface device further comprises a third electrically conductive spring clip and a fourth electrically conductive spring clip, said third spring clip and said fourth spring clip being electrically isolated from one another and from said first and said second spring clips, said third spring clip being engagable with said third terminal on said intermediate field, and said fourth spring clip being engagable with said fourth terminal on said intermediate field.

18. The network interface device according to claim 17, wherein said first, second, third and fourth electrically conductive spring clips are arranged in a two-by-two matrix.

19. A method of establishing an electrical connection between a first conductive terminal and a second conductive terminal extending outwardly from an intermediate field, said method comprising the following steps:

providing a connector having a jack and a plug insertable into said jack, providing an insert at least partially within said jack, said insert having a plurality of spring wires extending into said jack, said plug having at least one conductive blade therein, and said insert further including a plurality of electrically conductive spring clips therein, a first spring clip of said plurality of spring clips being electrically isolated from a second spring clip of said plurality of spring clips, a pair of said plurality of spring wires being electrically connected to respective ones of said first and second spring clips;

placing said connector onto said first terminal and said second terminal such that the first spring clip engages onto the first terminal and the second spring clip engages onto the second terminal; and placing said plug into said jack such that the at least one blade engages said pair of spring wires, thereby electrically connecting said pair of spring wires together, to thereby electrically connect the first spring clip to the second spring clip, and thereby electrically connecting the first terminal of the intermediate field to the second terminal of the intermediate field.

20. The method according to claim 19, wherein said first terminal is connected to a telephone network, and said second terminal is connected to a telephone subscriber line.

* * * * *